US006408644B1

(12) United States Patent
Williams

(10) Patent No.: US 6,408,644 B1
(45) Date of Patent: Jun. 25, 2002

(54) MICROWAVE HOME ENERGY HEATING AND COOLING SYSTEM

(76) Inventor: Don Williams, 552 E. Madison St., Pulaski, TN (US) 38478

( * ) Notice: Subject to any disclaimer, the term of this patent is extended or adjusted under 35 U.S.C. 154(b) by 0 days.

(21) Appl. No.: 09/643,015

(22) Filed: Aug. 21, 2000

(51) Int. Cl.[7] ..... F25B 33/00
(52) U.S. Cl. ..... 62/497; 62/467; 62/31
(58) Field of Search ..... 62/3.1, 467, 497; 165/96

(56) References Cited

U.S. PATENT DOCUMENTS 4,156,454 A 5/1979 Skala
4,408,463 A * 10/1983 Barclay ..... 62/3.1
4,439,656 A 3/1984 Peleg
4,599,866 A * 7/1986 Nakagome et al. ..... 62/3
4,731,250 A 3/1988 Stark
5,231,834 A * 8/1993 Burnett ..... 62/3.1
5,477,706 A 12/1995 Kirol et al.
5,490,398 A * 2/1996 Cline ..... 62/497
5,934,078 A * 8/1999 Lawton, Jr. et al. ..... 62/3.1

FOREIGN PATENT DOCUMENTS

JP 4-273956 A * 9/1992 ..... 62/3.1

* cited by examiner

*Primary Examiner*—William Doerrler
*Assistant Examiner*—Melvin Jones
(74) *Attorney, Agent, or Firm*—Waddey & Patterson, P.C.; David B. Pieper

(57) ABSTRACT

A heating system for applying heat to a heat input air conditioning system generator. The system teaches a wave converting system for transforming radio waves into heat. The wave converting system is placed in association with a heat input air conditioning generator to transfer heat from the converting system to the air conditioning generator. The wave converting system is impacted by radio waves from a radio wave emitter such as a magnetron.

20 Claims, 3 Drawing Sheets

MICROWAVE HOME ENERGY HEATING AND COOLING SYSTEM

BACKGROUND OF THE INVENTION

The present invention relates generally to heating and cooling systems for buildings and mobile enclosures. More particularly, this invention pertains to the use of a microwave-heating element for a heating and cooling system. Thus, this invention relates to a system that utilizes microwave particle excitation energy sources for thermal work-loads of indoor spaces such as heating, hot water, cooling and refrigeration.

The thermal work-load comprises approximately 83% of energy consumption of a modern all-electric home. Present day heat pumps backed up by AC electric heating elements and heat of compression, central air conditioners with electric strip heaters were introduced in the 1950's. These heat pumps have been around for almost five decades and are responsible for 55% of the total energy consumption in a home. The second largest energy use of the home is the electric hot water heater. Only minimal energy efficiency improvements have been made in the heating and cooling designs of heat pumps and hot water heaters over the last five to seven decades. However, refrigeration has significantly gained in energy efficiency since the first electric operated refrigerators were sold in large numbers in the 1940's.

Aqueous ammonia systems are used as three way power source refrigerators in travel trailers and motor homes. The use of ammonia for cooling applications dates back to the middle of the 1800's. By early in the 1900's, the use of ammonia as a refrigerant was largely perfected in a closed cycle of evaporation, compression and condensation. The advantages of ammonia over various types of freon are numerous. First, Ammonia costs less than freon. Second, ammonia has a lower density than freon so less material is needed to charge a system. Third, Ammonia is more efficient than freon. Ammonia's mass flow rate for a given refrigerating capacity is 1/7 that of HCFC-22. Thus, only one 1/7 the liquid needs to be pumped for a given refrigerating capacity and accordingly the mechanical and pumping system or thermal siphon circulating system will be smaller and use less power. Fourth, Ammonia requires smaller vapor line pipe sizes for large systems spread over a large area due to a reduced drop in saturation temperatures compared to freon. Fifth, ammonia systems are more tolerant of water contamination than freon systems. Finally, ammonia has more favorable heat-transfer coefficients than halocarbons.

A heat input refrigerator generally uses ammonia as the coolant. These heat input refrigerators use water, ammonia and hydrogen gas to create a continuous cycle for the ammonia coolant. These heat input refrigerators use a generator, separator, condenser, evaporator, and an absorber to create a flow cycle to create the cooling effect. The flow cycle works in several steps to provide the cooling effect and allow reuse of the ammonia. First, heat is applied to the generator by burning gas, propane, kerosene, etc. to heat a solution of ammonia and water within the generator. The input heat raises the temperature of the water and ammonia solution above the boiling point of the ammonia, and the boiling solution flows to the separator. In the separator the water separates from the ammonia gas. The ammonia gas then flows upward to the condenser which allows the ammonia gas to dissipate its heat and condense into a liquid. The liquid ammonia then flows to the evaporator where it mixes with hydrogen gas and evaporates, producing cold temperatures. The ammonia and hydrogen gas then flows to the absorber where the water collected in the separator is mixed with the ammonia and hydrogen gases. In this mixture, the ammonia forms a solution with the water and releases the hydrogen gas that flows back to the evaporator. The ammonia and water solution then flows to the generator where the cycle is repeated.

Another interesting field of the prior art includes microwave ovens that utilize radio waves to heat the food placed into the oven. Typical wave frequency for microwave ovens is 2.5 gigahertz. The radio waves at this frequency tend to be absorbed by water or food substances, while passing through glass or plastics. When these radio waves are absorbed by the food, the food converts the radio wave to heat and this causes the food to cook.

Generally, microwave ovens use a control system and an energy conversion system. The control system includes a relay for controlling the energy flow into a high voltage transformer. Power from the transformer is then sent to a rectifier that is used to power the magnetron. The magnetron then converts the electrical energy into the electromagnetic cooking energy. This electromagnetic energy is directed by a waveguide towards the food where a stirrer blade, rotating antennae, or a rotating plate is used to evenly distribute the energy onto the food. Metal shielding is used to contain the microwaves within the cooking compartment so that the waves bounce off of the container and impact the food from all sides.

A third interesting segment of the prior art is found in stealth technology used to hide aircraft from radar systems. The radar or microwaves consist of electric and magnetic fields and it is well known that an electric field exerts forces on charged particles. The use of magnetic fields to absorb radio energy from radar is well known in the field of stealth technology. As a microwave from a radar station penetrates a stealth technology composite, the composite turns the wave's energy into thermal energy and absorbs it. In fact, some of these radar absorbing materials or composites include magnetic materials that respond to the magnetic field of the microwaves.

These prior art segments have, until now, not been combined to provide improved heat generation for air conditioning systems or hot water heating systems. Due to inefficiencies of the prior art, the present invention is utilized to allow microwave heating of refrigeration units, with improved results obtained by utilizing permanent magnets of oriented strontium ferrite in the heating process.

SUMMARY OF THE INVENTION

The present invention teaches a hybrid energy system for combining multiple energy resources. One unique aspect of the present invention teaches an air conditioning energy reactor for converting electricity into heat for use in an air conditioning system. The system utilizes a radio wave generator for converting electricity into microwaves that are directed at a target that receives the radio waves and converts them into heat.

One preferred embodiment of the present invention teaches the use of a magnetron to convert the electricity to radio waves.

One advantage of the present invention includes the use of a wave guide to direct the radio waves towards the target.

A further advantage of the present invention utilizes a power supply for controlling and modifying the characteristics of the electricity before the electricity is sent to the magnetron.

Yet another aspect of the present invention teaches a temperature sensor for generating a temperature signal corresponding to the heat of the target and a controller for operating the power supply according to the temperature signal.

One embodiment of the present invention utilizes a power relay for controlling flow of the electricity that is connected to a power transformer for transforming the electricity into high voltage power. The electricity then flows into a power rectifier connected to the power transformer, the power rectifier converts the high voltage power into direct current power. This rectified power is run through a filter for smoothing the direct current power to create a smooth direct current power that is supplied to a magnetron. The magnetron converts the smooth direct current power into radio waves that are guided to a target by a wave guide. The reactor is controlled through the use of a heat sensor thermally connected to the air conditioning system to monitor the heat generated by the target and output a temperature signal. This temperature signal is used by a controller for operating the power relay.

One advantage of the present invention is the use of a magnetic target for converting the radio waves into heat. The present invention utilizes a permanent magnet constructed from a ceramic such as an oriented strontium ferrite.

Yet another advantage of the present invention is the use of a backup electrical heating element.

In this manner, the present invention teaches a heating system for applying heat to a heat input air conditioning system generator. The system teaches a wave converting system for transforming radio waves into heat. The wave converting system is placed in association with a heat input air conditioning generator to transfer heat from the converting system to the air conditioning generator. The wave converting system is impacted by radio waves from a radio wave emitter such as a magnetron.

The present invention provides an energy reduction for the thermal work load when compared to the compression heat pump for heating and cooling, the compressor operated refrigerator, and the electric water heater.

The hybrid energy system includes a vacuum-jacketed, insulated storage of energy.

The insulated storage of the present invention helps to better utilize energy from nature such as concentrated solar power and concentrated wind power.

The present invention also provides a multiple-energy compatible, on demand, efficient, year-round, back up energy, coupling reactor that utilizes high frequency energy from a magnetron to excite the energy field of a group of high energy, high temperature, permanent magnets. This method of exciting the energy field yields heat by impacting permanent magnets with microwaves from a magnetron.

It is an object of the present invention to provide a practicable and affordable system that can accomplish air heating and air cooling of indoor space and the heating of hot water as well as energy for food preservation by utilizing economical hybrid energy sources.

It is another object of the invention to provide the refrigeration and cooling of an aqueous ammonia absorption system utilizing ammonia 717.

It is another object of this invention to utilize the heat produced from the stress of permanent magnetic fields of force or the increased molecular activity, causing increased friction from the energy coupling reaction reactor.

DESCRIPTION OF THE PREFERRED EMBODIMENTS

Figure 1:
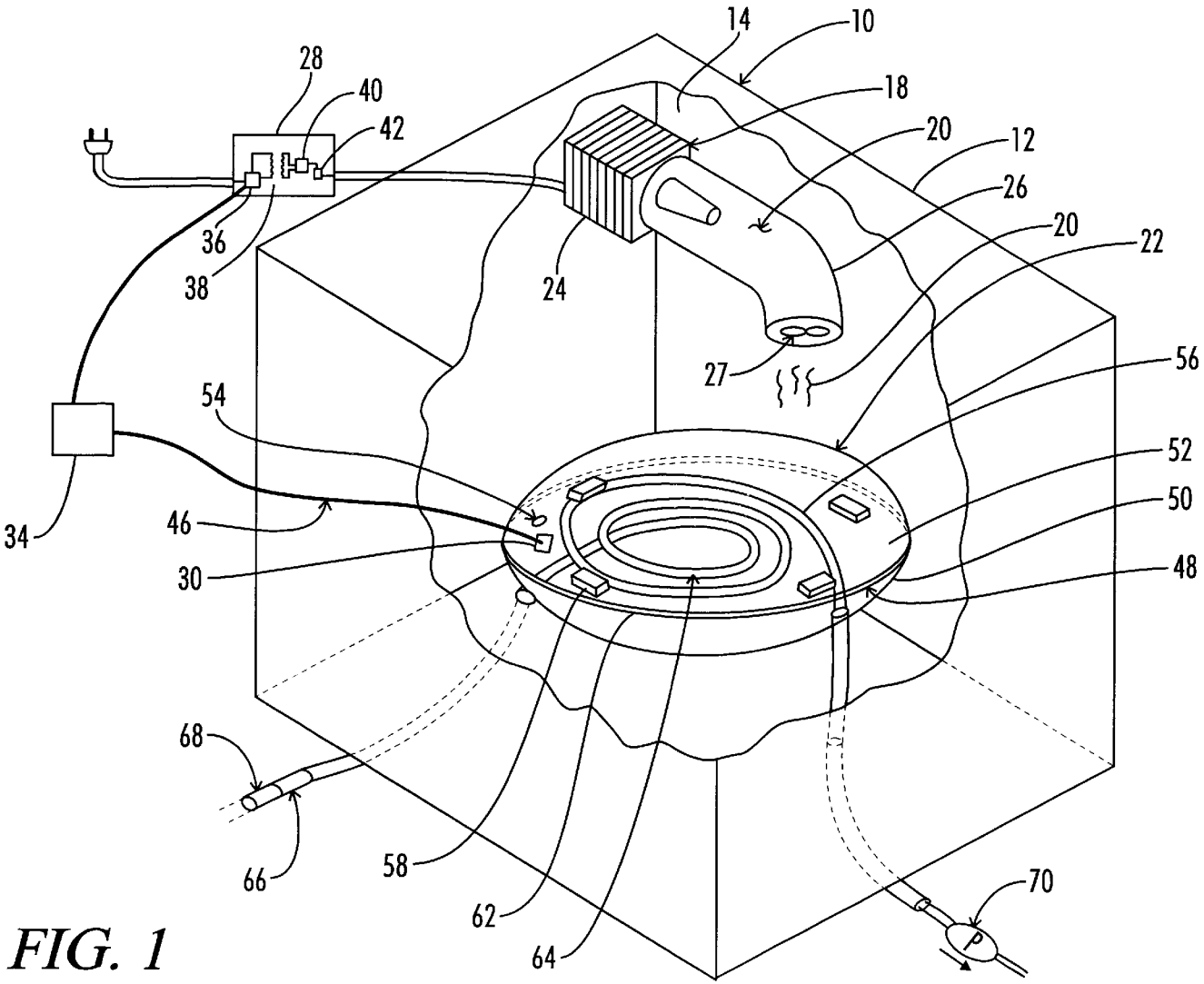
FIG. 1 is a schematic drawing of an energy coupling reactor.

FIG. 1 of the drawings shows an air conditioning energy reactor 10 for converting electricity to heat for use in an air conditioning system 16. The reactor 10 includes a radio wave generator 18 for converting electricity into radio waves 20, and a target 22, for receiving the radio waves 20 and converting the radio waves 20 into heat. The reactor 10 is housed in a rectangle-shaped housing 12 that is lined with radiation protection lining 14 to enclose the radio wave generator 18.

The a radio wave generator 18 includes a magnetron 24 to convert the electricity to radio waves 20 as well known in the prior art of microwave ovens. A power supply 28 is used to control the power flow of the electricity to the radio wave generator 18. The power supply 28 is also used to modify the characteristics of the electricity before the electricity is sent to the magnetron 24. The power supply 28 is also well known in the prior art and the well known elements of the power supply utilized for the present invention are described in the following discussion.

In the power supply 28, the electricity flows through a power relay 36 which is used to control the flow of the electricity. A power transformer 38 is connected to the power relay 36 for transforming the electricity into high voltage power. A power rectifier 40 is then connected to the power transformer 38 for converting the high voltage power into direct current power, and a filter 42 is used for smoothing the direct current power supplied from the power rectifier 40 to create a smooth direct current power. A magnetron 24 is then used to convert the smooth direct current power to microwaves 20, also known as radio waves 20. The radio wave generator 18 also includes a wave guide 26 that is used to direct the radio waves 20 towards the target 22, and a fan 27 that is used to distribute the waves to the target 22.

In the preferred embodiment, the radio wave generator 18 also includes a heat, or temperature sensor 30 that is thermally connected to the air conditioning system 16 to monitor the heat generated by the target 22 and output a temperature signal 46. The temperature signal 46 is used by a controller 34 for operating the power relay 36 according to the temperature signal 46. The air conditioning energy reactor 10 utilizes the temperature sensor 30 for generating the temperature signal 32 corresponding to the heat of the target 22 and the controller 34 for operating the power supply 28 according to the temperature signal 32. Once the preferred embodiment of the reactor 10 is turned on, the controller 34 allows electricity to flow into the magnetron 24 until an upper temperature limit is sensed. The controller 34 then turns off the electrical power to the magnetron 24 until the target 22 cools to a minimum temperature setting. Once the minimum temperature setting is achieved, then the reactor 10 begins a new cycle by turning on the magnetron 24 to reheat the target 22. This cycle continues during normal operation of the reactor 10. The upper and lower temperature settings may be programmed in accordance with the demands on the air conditioning system 16.

The target 22 includes a thermal pressure chamber 48 which is shaped like two turtle shells with the bottom 50 made of steel that is lined with ceramic and the top 52 made of tempered, thick glass. The thermal pressure chamber 48 contains a pressure relief valve 54 set to relieve overload stresses on the thermal pressure chamber 48. Inside the thermal pressure chamber 48 is a honeycomb ceramic block 56 with imbedded permanent magnets 58. These magnets 58 can be used to impart heat into the ceramic 56 which is then transferred to the transfer medium 60. The transfer medium 60 can be composed of a mixture of cooking oil and rock salt for transferring only the heat, or the transfer medium can be an aqueous ammonia solution for use in a refrigeration system 16. Thus, the transfer medium 60 transfers the heat to another location.

Also shown in FIG. 1 is a thermal seal 62 that is used between the top 52 and bottom 50 chambers for pressure confinement. Transport of the heat transfer medium 60, at temperatures up to 480 degrees Fahrenheit, is accomplished by a high temperature, microwave permeable hose or ceramic tubing 64. A heat transfer medium pressure controller 66 and temperature controller 68 are located just outside the cabinet 12 in the high temperature hose 64. For reactors 10 utilizing a cooking oil style of heat transfer medium 60, circulation can be performed by a circulating pump 70.

The target 22 includes ferrite, which can be magnetized as a magnetic material, and the preferred embodiment utilizes a permanent magnet 58. Through experimentation, it has been found that the permanent magnets 58 heat extremely well in the microwave path, and it is believed that the magnetic charge on these magnets increases the heat output through an energy collision impact. These permanent magnets 58 are constructed from a ceramic material, and specifically, the magnets 58 are constructed from an oriented strontium ferrite. A backup electrical heating element 72 may also be utilized to supply heat to the target 22 in case of a failure of the radio wave generator.

Thus, the present invention teaches a heating system for applying heat to a heat input air conditioning system generator. The heating system utilizes a wave converting system for transforming radio waves into heat and is placed in association with the air conditioning generator to transfer the heat from the converting system to the air conditioning generator. The radio waves are generated by a radio wave emitter. The radio waves then impact the wave converting system. A wave guide is also positioned with both the radio wave emitter and the wave converting system to direct the radio waves from the radio wave emitter onto the wave converting system, and a temperature sensor is placed to monitor the heat supplied to the air conditioning generator. This temperature sensor generates a temperature signal in accordance with the temperature sensed. A control system is connected to the temperature sensor for controlling the generation of the radio waves by the radio wave emitter in response to the temperature signal received from the temperature sensor.

Figure 2:
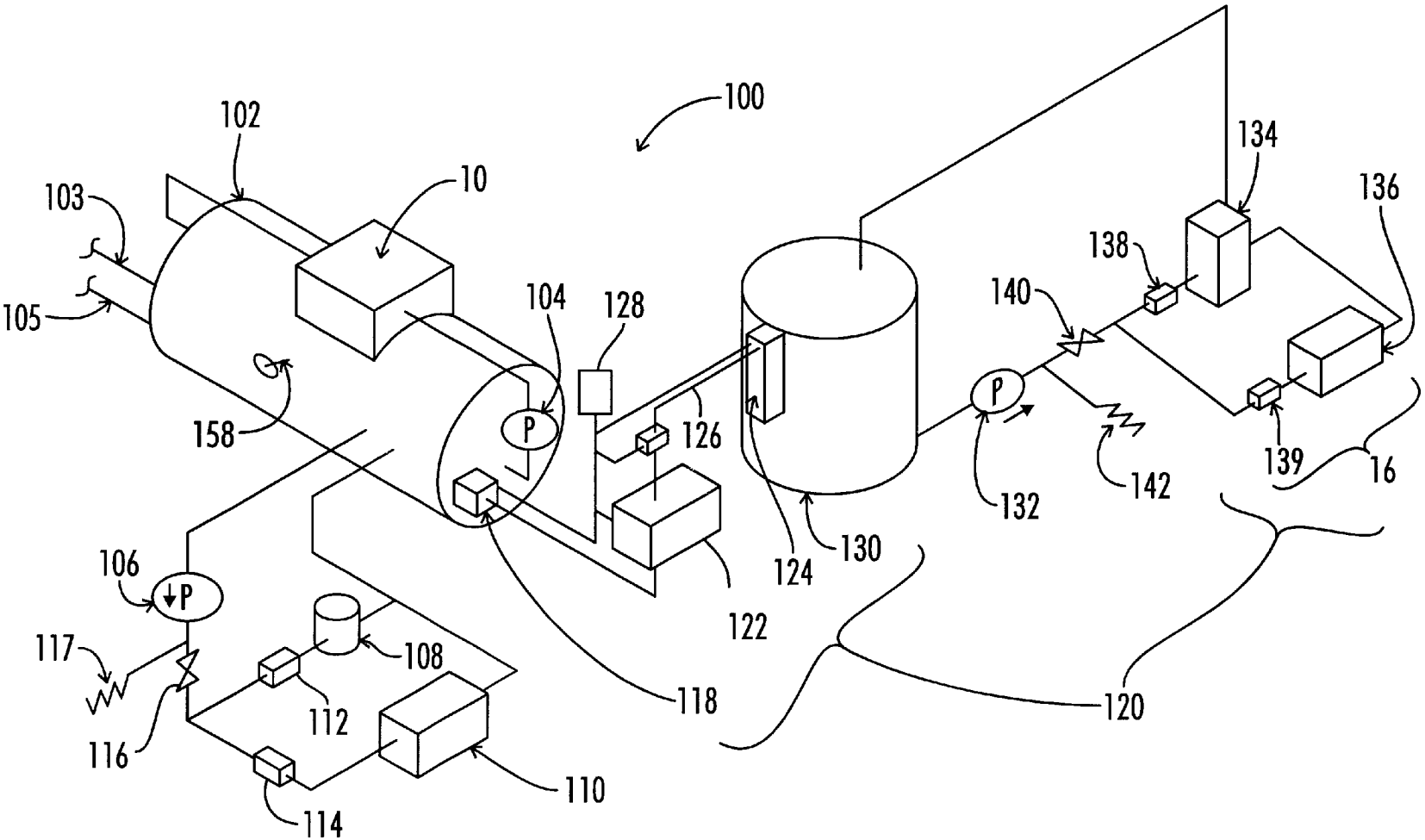
FIG. 2 is a schematic drawing of an energy storage and distribution system.

FIG. 2 shows an example of an energy storage and distribution system 100 with a hot solution vacuum jacketed tank 102 and an energy coupling reactor 10. The energy coupling reactor 10 is mounted on top of the vacuum jacketed tank 102, and a circulating pump 104 is connected between the vacuum jacketed tank 102 and the energy coupling reactor 10. In this manner, a non-toxic, non-corrosive, antifreeze hot solution in the tank may be heated. Auxiliary heat may also be added through auxiliary heat input 103 and auxiliary heat output 105.

A heat distribution pump 106 is connected to the hot solution vacuum jacketed tank 102. This heat distribution pump 106 supplies the hot solution to a hot water heater 108 and a space heat exchanger 110. Control of the hot solution flow is accomplished by temperature controllers 112 and 114. A temperature valve 116 is also supplied for use in a hot control humidity control circuit 117.

Also connected to the hot solution vacuum jacketed tank 102 is a generator 118 used in an aqueous ammonia cooling system 120. The aqueous ammonia cooling system 120 includes the generator 118, an accumulator 122, and an evaporator 124 connected by the necessary piping 126 and controls 128 to a cold solution vacuum jacketed tank 130. From the cold solution jacketed tank 130, a cold distribution pump 132 supplies a cool solution to the refrigerator 134 and the space cooling exchanger 136. Control is obtained through the use of temperature controllers 138 and 139 and a temperature valve 140. Also supplied on the cold side is a cold control humidity control circuit 142.

Figure 3:
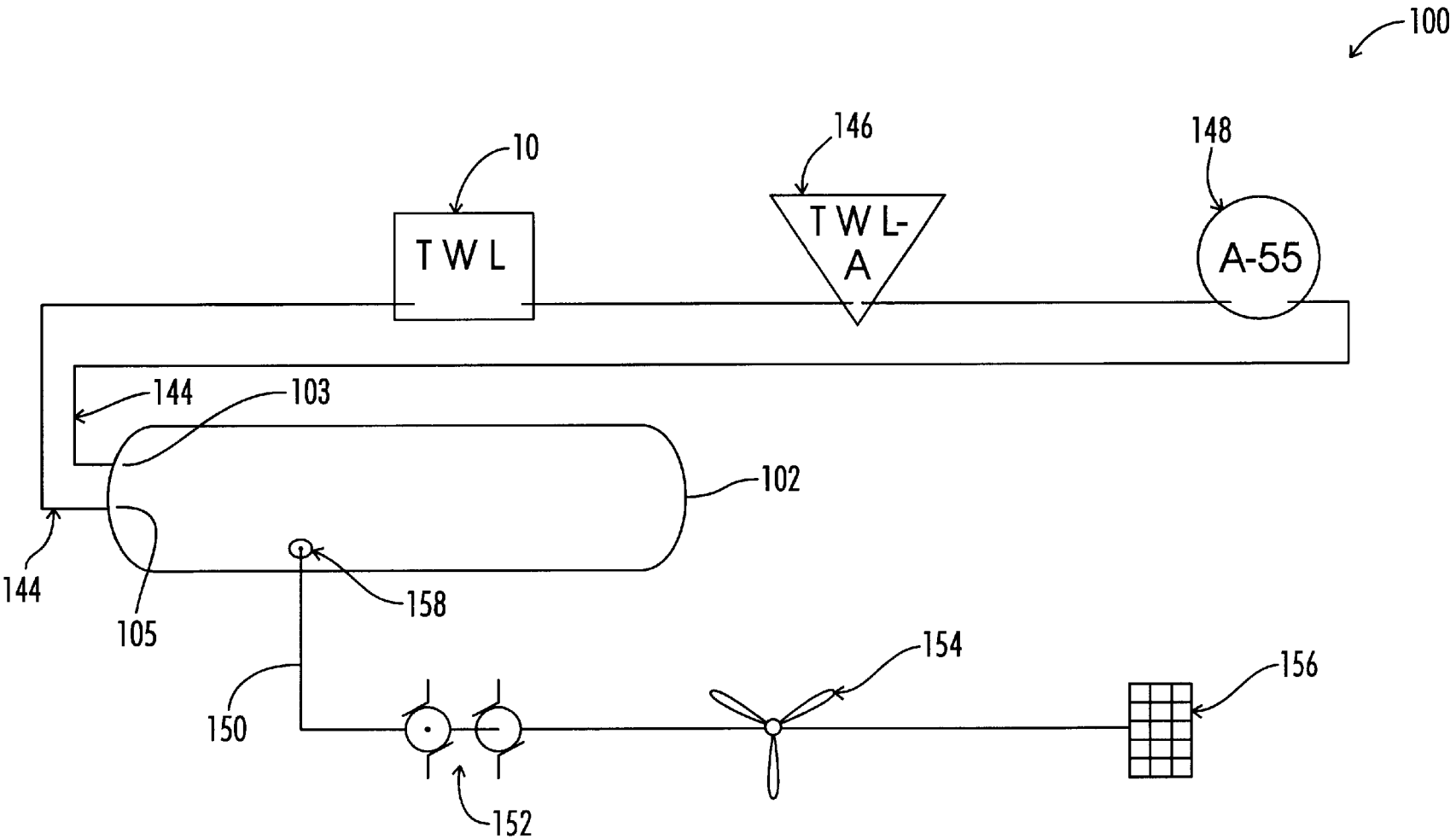
FIG. 3 is a schematic drawing of an energy concentration system using hybrid energy resources.

FIG. 3 shows the energy storage and distribution system 100 with six different energy sources. Each of these energy sources is connected by appropriate means to a hot solution vacuum jacketed tank 102. An average home in the U.S. uses approximately 100,000 British Thermal Units (BTU's) per day for thermal work loads. Approximately 83% of this total energy comprises heating and cooling such as heating of water and cooling or refrigeration of food. Thus, a 500 gallon tank with a 10 pound per gallon solution heated to 480 Fahrenheit and allowing for uses down to 180 F would amount to a 15 day energy storage for an average home. Two 500 gallon or one 1000 gallon tanks would store enough energy for a full month of average energy usage.

As shown in FIG. 3. several different energy resources may be used to heat the hot solution vacuum jacketed tank 102. A piping system 144 is used to connect an energy coupling reactor 10, a concentrated solar source 146, and an external combustion source 148 for directly heating the solution in the hot solution vacuum jacketed tank 102. An electrical cable system 150 is used to connect an internal combustion motor-generator 152, a concentrated electrical generation wind source 154, and a concentrated electrical generation solar source 156 to a hot solution heating element 158 in the hot solution vacuum jacketed tank 102.

The present magnetron-magnet refrigeration concept was proven utilizing readily available materials. It is expected that additional efficiency improvements and material exchanges can be made to improve the unit efficiency and operating performance over the items used in this proof of design example. The main refrigerator unit used for the proof of design embodiment is a Norcold 776EG3 aqueous ammonia refrigerator which may be obtained from Mid-West Products, Corning, Iowa. This unit is designed to operate on any of three potential power supplies including 12 volt electric, 120 electric, and propane. The unit used for the actual design concept embodiment was obtained as a used unit from a 1984 Prowler Travel Trailer. An electric heating element rated at 200 watts was inserted into the short pipe attached to the aqueous ammonia generator. This element is designed to operate on 12 volt or 120 volt electric power supplies and is also available from Mid-West Products, Corning, Iowa. The element uses approximately 156 watts per hour at 120 volts electrical power supply to heat the aqueous solution for this refrigerator. This electrical heating element was installed to be used as a back up power source for a magnetron-magnet power system that will be described in further detail herein.

The main heating component of the refrigeration system is the microwave heating system. This system includes a 750 watt-hour magnetron normally used in a microwave cooking oven. The 750 watt-hour size is a fairly typical design size used microwave cooking ovens. Once again, the magnetron utilized for the present invention was obtained form a used microwave cooking oven. A wave guide is also utilized to shield the radiation energy output of the magnetron and channel the energy output by the magnetron. The wave guide for the present design was obtained from the same used microwave oven, and was adapted with sheet metal working tools to provide the necessary shielding and channeling of the energy.

Three permanent magnets were obtained from Radio Shack under part number 640–1877. These specifications for these High-energy Ceramic Magnets are as follows:

Description: Ceramic Block 1.87×0.87×0.390 Inches

Material: Oriented Strontium Ferrite

Magnetic Properties:

- Residual Flux Density (B sub r): 3,850 Gauss
- Coercive Force (H sub c): 2,950 Oersteds
- Max Energy Product (BH sub max): 3.5 MG * Oe
- Average Recoil Permeability: 1.1
- Field Strength needed to saturate: 10,000 Oe
- Temperature needed to permanently ruin: 1,800 Degrees F Physical Properties:

- Density: 0.180 lbs/In^3
- Coefficient of Thermal Expansion: 10.3 per degrees C×10^−6
- Resistivity at 25 degrees C: 10^10 micro-Ohms/cm/cm^2
- Rockwell Hardness Scales: off C
- Dimensions (HWD): ⅜×1–⅞×⅞ Inches Radio Shack lists these specifications with the note that these specifications are typical and that individual magnets might vary. Four pounds of rock salt were obtained from a local grocery distributor as originally packaged and sold Morton International, Inc. of Chicago Ill.

The heating reactor and refrigeration system is assembled by removing the cover of the sheet metal electrical heating element box on the refrigeration unit for access through the insulation to the generator pipe. A three inch gap is cut into the insulation, and the insulation is removed from approximately one-quarter of the circumference. The three permanent magnets are attached to the steel generator pipe by the magnetic attraction of the magnets. The rock salt is then placed around the back and sides of the generator pipe and the magnets. The rock salt is held in place by the insulation and the electrical heating element box. The magnetron is mounted to the heating element box to direct the main force of the magnetron onto the magnets. The wave guide is then shaped and placed between the magnetron and the permanent magnets to focus the energy of the magnetron onto the permanent magnets.

A power supply cord is then attached between the magnetron and a power supply relay. The sensor from a four hundred and fifty degree safety control unit is then attached to the refrigerator unit or solution storage tank and the power supply relay. In this manner, the safety control unit can control the electrical power supplied through the power supply cord to the magnetron. The control unit will cycle the magnetron on and off to maintain the selected temperature at the generator pipe. The four hundred and fifty degree selection was chosen because the permanent magnets have a maximum operating temperature of six hundred degrees, and so a one hundred and fifty degree safety margin was used to protect the magnets. Additionally, this embodiment of the design has proven that the four hundred to four hundred and fifty degree range was efficient for an aqueous ammonia refrigerator. Complete microwave shielding is then built to contain the microwave energy. A note of caution, the entire microwave system should be checked using a microwave radiation detector to ensure that the unit does not leak. Once the microwave heating system has been constructed, power may be supplied to the magnetron, and the cooling cycle may be commenced. This embodiment of the present invention was designed to utilize both 120 volt and 12 volt power requirements to allow for the use of photovoltaic panels, wind mills, or other environmentally friendly energy sources which provide low voltage power.

Thus, although there have been described particular embodiments of the present invention of a new and useful Microwave Home Energy System, it is not intended that such references be construed as limitations upon the scope of this invention except as set forth in the following claims.

What is claimed is:

1. An air conditioning energy reactor for converting electricity to heat for use in an air conditioning system, comprising:

a radio wave generator for converting electricity into radio waves; and a wave converting target for receiving the radio waves and converting the radio waves into heat, the wave converting system operably placed in association with an air conditioning generator to transfer heat from the converting system to the air conditioning generator.

2. The reactor of claim 1, the a radio wave generator comprising a magnetron to convert the electricity to radio waves.

3. The reactor of claim 1, the a radio wave generator comprising a wave guide to direct the radio waves towards the target.

4. The reactor of claim 2, the a radio wave generator further comprising a power supply for controlling and modifying the characteristics of the electricity before the electricity is sent to the magnetron.

5. The reactor of claim 4, the a radio wave generator further comprising a temperature sensor for generating a temperature signal corresponding to the heat of the target; and a controller for operating the power supply according to the temperature signal.

6. The reactor of claim 1, the radio wave generator comprising a power relay for controlling flow of the electricity;

a power transformer connected to the power relay for transforming the electricity into high voltage power;

a power rectifier connected to the power transformer for converting the high voltage power into direct current power;

a filter for smoothing the direct current power supplied from the power rectifier to create a smooth direct current power;

a magnetron to convert the smooth direct current power to radio waves; and a wave guide to direct the radio waves towards the target.

7. The reactor of claim 1, the a radio wave generator further comprising a heat sensor thermally connected to the air conditioning system to monitor the heat generated by the target and output a temperature signal; and a controller for operating the power relay according to the temperature signal.

8. The reactor of claim 1, wherein the target is magnetic.

9. The reactor of claim 1, wherein the target is a permanent magnet.

10. The reactor of claim 1, wherein the target is constructed from a ceramic.

11. The reactor of claim 1, wherein the target is constructed from an oriented strontium ferrite.

12. The reactor of claim 1, further comprising a backup electrical heating element.

13. A heating system for applying heat to a heat input air conditioning system generator, comprising:

a wave converting system for transforming radio waves into heat, the wave converting system operably placed in association with the air conditioning generator to transfer heat from the converting system to the air conditioning generator; and a radio wave emitter for emitting radio waves which impact the wave converting system.

14. The heating system of claim 13, further comprising:

a wave guide operably positioned with both the radio wave emitter and the wave converting system to direct the radio waves from the radio wave emitter onto the wave converting system.

15. The heating system of claim 13, further comprising:

a temperature sensor operably placed to monitor the heat supplied to the air conditioning generator by the wave converting system and generate a temperature signal.

16. The heating system of claim 15, further comprising:

a control system for controlling the generation of the radio waves by the radio wave emitter in response to the temperature signal received from the temperature sensor.

17. The heating system of claim 13, wherein the wave converting system includes a magnetic substrate.

18. The heating system of claim 13, wherein the wave converting system includes a ceramic.

19. The heating system of claim 13, wherein the wave converting system includes an oriented strontium ferrite.

20. A method for generating heat in an air conditioning system, including:

placing a wave converting target including a magnetic field of force in association with an air conditioning system generator;

bombarding the wave converting target including a magnetic field of force with microwave energy;

converting the microwave energy to heat with the wave converting target; and transferring the heat to the air conditioning generator.

* * * * *